US008286962B2

(12) United States Patent
Tanaka

(10) Patent No.: US 8,286,962 B2
(45) Date of Patent: Oct. 16, 2012

(54) SHEET MEMBER FEEDER DEVICE AND IMAGE FORMING APPARATUS

(75) Inventor: Toru Tanaka, Niigata (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 12/779,503

(22) Filed: May 13, 2010

(65) Prior Publication Data

US 2011/0140352 A1 Jun. 16, 2011

(30) Foreign Application Priority Data

Dec. 15, 2009 (JP) ..... 2009-284278

(51) Int. Cl.
*B65H 1/00* (2006.01)

(52) U.S. Cl. ..... 271/171

(58) Field of Classification Search ..... 271/171, 271/145
See application file for complete search history.

(56) References Cited

U.S. PATENT DOCUMENTS 7,377,509 B2 * 5/2008 Ito ..... 271/171
2006/0113725 A1 * 6/2006 Ito ..... 271/171

FOREIGN PATENT DOCUMENTS

JP 5-319584 * 12/1993
JP 2000-327140 A 11/2000

* cited by examiner

*Primary Examiner* — Gerald McClain
*Assistant Examiner* — Thomas Morrison
(74) *Attorney, Agent, or Firm* — Sughrue Mion, PLLC

(57) ABSTRACT

A sheet member feeder device includes: a sheet member housing section that houses a sheet member for feeding; a guide member, provided so as to be movable in approach-separation directions that approach towards, or separate away from, an edge of the sheet member housed in the sheet member housing section, the guide member guiding the edge of the sheet member; a restricting member that is provided to the guide member, the restricting member engaging with an engaged portion provided to the sheet member housing section and restricting movement of the guide member in the approach-separation directions; and a pressing member that, when the restricting member is engaged with the engaged portion, presses the guide member towards the sheet member by the pressing member inserting further into a gap between the restricting member and the guide member.

2 Claims, 17 Drawing Sheets

SHEET MEMBER FEEDER DEVICE AND IMAGE FORMING APPARATUS

CROSS-REFERENCE TO RELATED APPLICATION

This application is based on and claims priority under 35 USC 119 from Japanese Patent Application No. 2009-284278 filed on Dec. 15, 2009.

BACKGROUND

1. Technical Field

The present invention relates to a sheet member feeder device and an image forming apparatus.

2. Related Art

Sheet member feeder devices that feed out a recording medium stacked in a cassette tray one sheet at a time have previously been proposed.

SUMMARY

A sheet member feeder device of a first aspect of the present invention includes: a sheet member housing section that houses a sheet member for feeding; a guide member, provided so as to be movable in approach-separation directions that approach towards, or separate away from, an edge of the sheet member housed in the sheet member housing section, the guide member guiding the edge of the sheet member; a restricting member that is provided to the guide member, the restricting member engaging with an engaged portion provided to the sheet member housing section and restricting movement of the guide member in the approach-separation directions; and a pressing member that, when the restricting member is engaged with the engaged portion, presses the guide member towards the sheet member by the pressing member inserting further into a gap between the restricting member and the guide member.

BRIEF DESCRIPTION OF THE DRAWINGS

Exemplary embodiments of the present invention will be described in detail based on the following figures, wherein:

FIG. 7A is a plan view thereof, FIG. 7B is a side view thereof, and FIG. 7C is a front view thereof;

DETAILED DESCRIPTION

Explanation follows of an exemplary embodiment of an image forming apparatus equipped with a sheet member feeder device according to the present invention, with reference to the drawings.

Overall Configuration of Image Forming Apparatus

Figure 1:
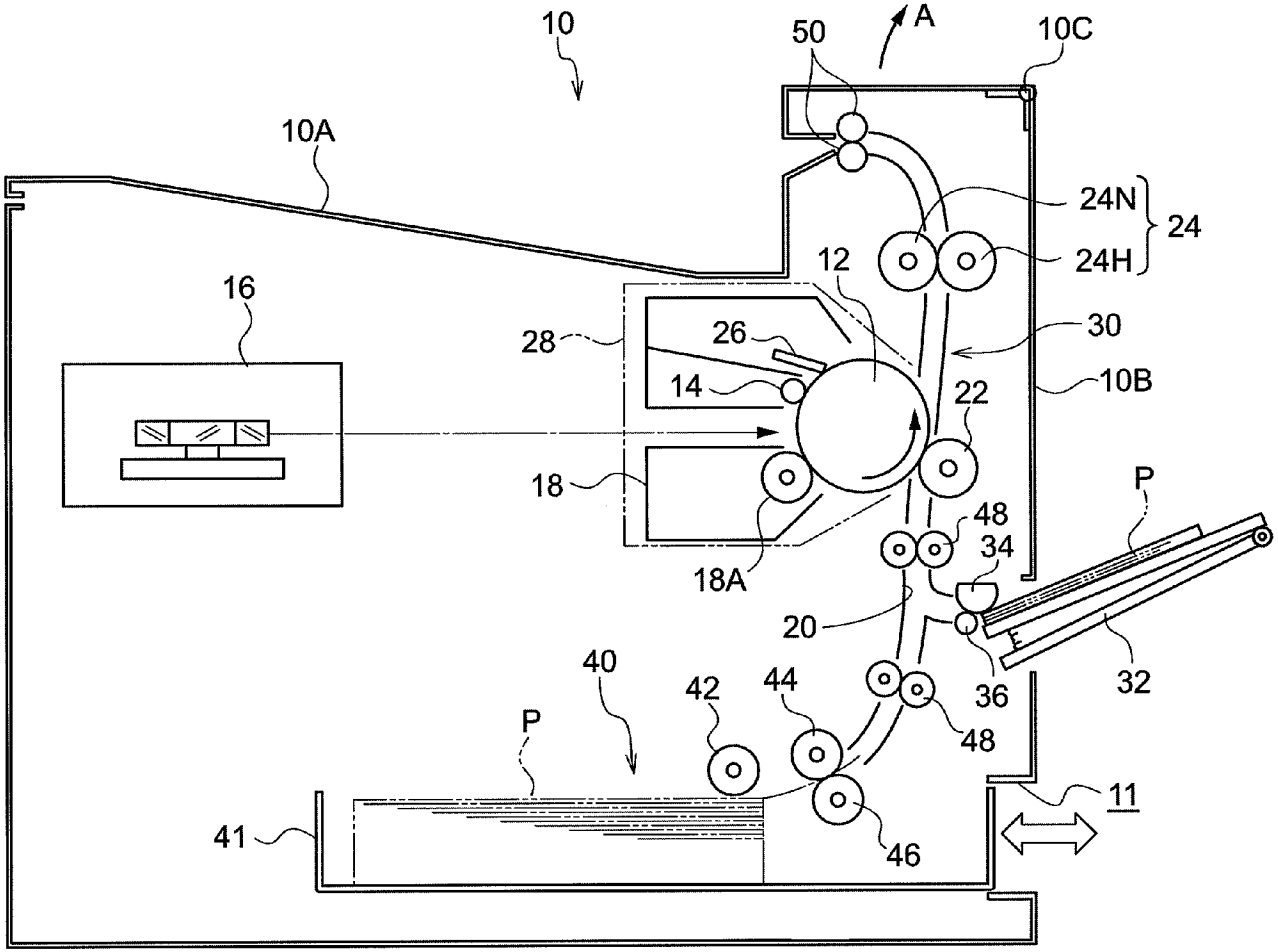
FIG. 1 is a schematic configuration diagram showing an image forming apparatus equipped with a sheet member feeder device according to a first exemplary embodiment of the present invention.

First, based on FIG. 1, explanation follows regarding the overall configuration of an image forming apparatus equipped with a sheet member feeder device according to an exemplary embodiment.

As shown in FIG. 1, an image forming apparatus 10 includes: a photoreceptor 12 that, after being uniformly charged, is formed on the surface with an electrostatic latent image by illumination of a laser light; a charging device 14 that uniformly charges the surface of the photoreceptor 12; a light exposure device 16 that, based on image data, illuminates a laser light onto the photoreceptor 12 thereby forming an electrostatic latent image; a developing device 18 that selectively transfers toner onto the electrostatic latent image, making the electrostatic latent image visible as a toner image; a transfer roll 22 that transfers the toner image on the surface of the photoreceptor 12 onto paper P, as an example of a sheet member (recording medium) being fed along a conveying path 20; a fixing device 24 that applies heat and pressure to the toner image on the paper P, fixing the toner image to the paper P; and a cleaning device 26 that cleans off toner that remains on the photoreceptor 12 after the toner image has been transferred. The image forming apparatus 10 is covered by a main body side-face cover 10B and a top plate 10A.

The photoreceptor 12, the charging device 14, the developing device 18, and the cleaning device 26 are attachable and detachable, as a single developing unit 28, to and from a main body frame (not shown in the figures) inside the image forming apparatus 10. The inside of the image forming apparatus 10 can be opened up by rotating the top plate 10A in the arrow A direction about a pivot point of a shaft 10C provided at a top corner portion of the main body side-face cover 10B.

A manual paper feed tray 32 is provided at the side of the image forming apparatus 10, such that paper P can be manually fed into an image forming section 30, and a half-moon shaped feed roll 34 is provided to the manual paper feed tray 32. A retarding roll 36 is also provided, with the paper P nipped between the feed roll 34 and the retarding roll 36. The retarding roll 36 is axially supported by support members, not shown in the figures, provided at both ends of the retarding roll 36, and the retarding roll 36 is also biased towards the feed roll 34 by biasing force of coil springs incorporated within the support members. Due to such a configuration, when the feed roll 34 is rotated, the paper P lying on the manual paper feed tray 32 is fed to the image forming section 30 one sheet at a time by the feed roll 34 and the retarding roll 36.

A paper feeder device 40 that feeds out the paper P one sheet at a time is also provided, as an example of a sheet member feeder device, at the bottom within the image forming apparatus 10. The paper feeder device 40 includes a paper feed cassette 41, as an example of a sheet member housing section, in which plural sheets of the paper P are stacked, the paper P stacked in the paper feed cassette 41 being taken out in sequence by a pick-up roll 42. The paper feeder device 40 is configured such that the paper P is conveyed one sheet at a time by a rotationally driven feed roll 44 and a separator roll 46 provided to the paper feed cassette 41. Details regarding the paper feeder device 40 are given below.

Furthermore, the above photoreceptor 12 has a photoconductive layer on its surface that, due to light exposure after being uniformly charged, attenuates in electrical potential at the light exposed portions.

The charging device 14 is a roll shaped member that makes contact with the photoreceptor 12, and, due to application of a voltage across the charging device 14 and the photoreceptor 12, electrical discharge occurs at small gaps in the vicinity of the contacting portion, so as to substantially uniformly charge the surface of the photoreceptor 12. As well as the above configuration, a charging device in which a high voltage is applied to a wire electrode can also be employed as the charging device 14, with the photoreceptor 12 being charged by corona discharge.

The light exposure device 16 scans an intermittent laser light onto the peripheral surface of the photoreceptor 12, forming an electrostatic latent image on the peripheral surface of the photoreceptor 12 based on image data. Note that an array of light emitting elements, such as, for example LED's, may be employed as a recording device, with the light emitting elements switched on and off according to the image data.

Furthermore, the developing device 18 has a roll shaped developing roll 18A disposed so as to face the photoreceptor 12 in close proximity thereto, and a developing bias voltage is applied between the developing roll 18A and the photoreceptor 12. A developing bias field is thereby formed between the developing roll 18A and the photoreceptor 12, causing charged toner to migrate onto the light exposed portions on the photoreceptor 12, thereby forming a toner image on the surface of the photoreceptor 12.

The transfer roll 22 is a roll shaped member provided so as to face the photoreceptor 12. The transfer roll 22 makes the toner image migrate onto the paper P passing through the image forming section 30 by forming a transfer electrical field between itself and the photoreceptor 12.

The image forming apparatus 10, configured as described above, forms an image in the following manner.

First, the voltage-applied charging device 14 negatively charges the surface of the photoreceptor 12 at the planned uniform electrical potential.

Then, the light exposure device 16 forms a electrostatic latent image on the charged photoreceptor 12, either based on image data read in by a scanner, not shown in the figures, or based on external data that has been input.

Namely, based on video data supplied from a control device, not shown in the figures, an electrostatic latent image, corresponding to the image data, is formed on the photoreceptor 12 by switching a laser on and off. The electrostatic latent image is then made visible as a toner image by toner supplied from the developing roll 18A provided to the developing device 18.

The paper P taken out from the paper feed cassette 41 by the pick-up roll 42 is passed, one sheet at a time, to rollers 48 by the feed roll 44 and the separator roll 46, and fed out along the conveying path 20. A toner image is transferred onto the paper P passing through the image forming section 30, between the photoreceptor 12 and the transfer roll 22. The transferred toner image is fixed to the paper P by the paper P passing through between a heating roll 24H and a pressing roll 24N provided to the fixing device 24, and the paper P is discharged onto the top face of the top plate 10A by discharge rolls 50.

Note that while in the image forming apparatus 10 of the present exemplary embodiment there is a single developing device 18, when color images are to be formed, configuration is with developing devices 18 for four colors, yellow (Y), magenta (M), cyan (C) and black (K), disposed in positions to face the photoreceptor 12.

Paper Feeding Device

Next, explanation follows regarding the paper feeder device 40.

As shown in FIG. 1, an opening 11 is provided in the main body side-face cover 10B, in order to take out, and put in, the paper feed cassette 41 of the paper feeder device 40, so that the paper P can be replenished in the paper feed cassette 41 by pulling the paper feed cassette 41 out from the opening 11 by gripping a handle 62 (see FIG. 2) provided to a side plate 60 of the paper feed cassette 41.

Figure 2:
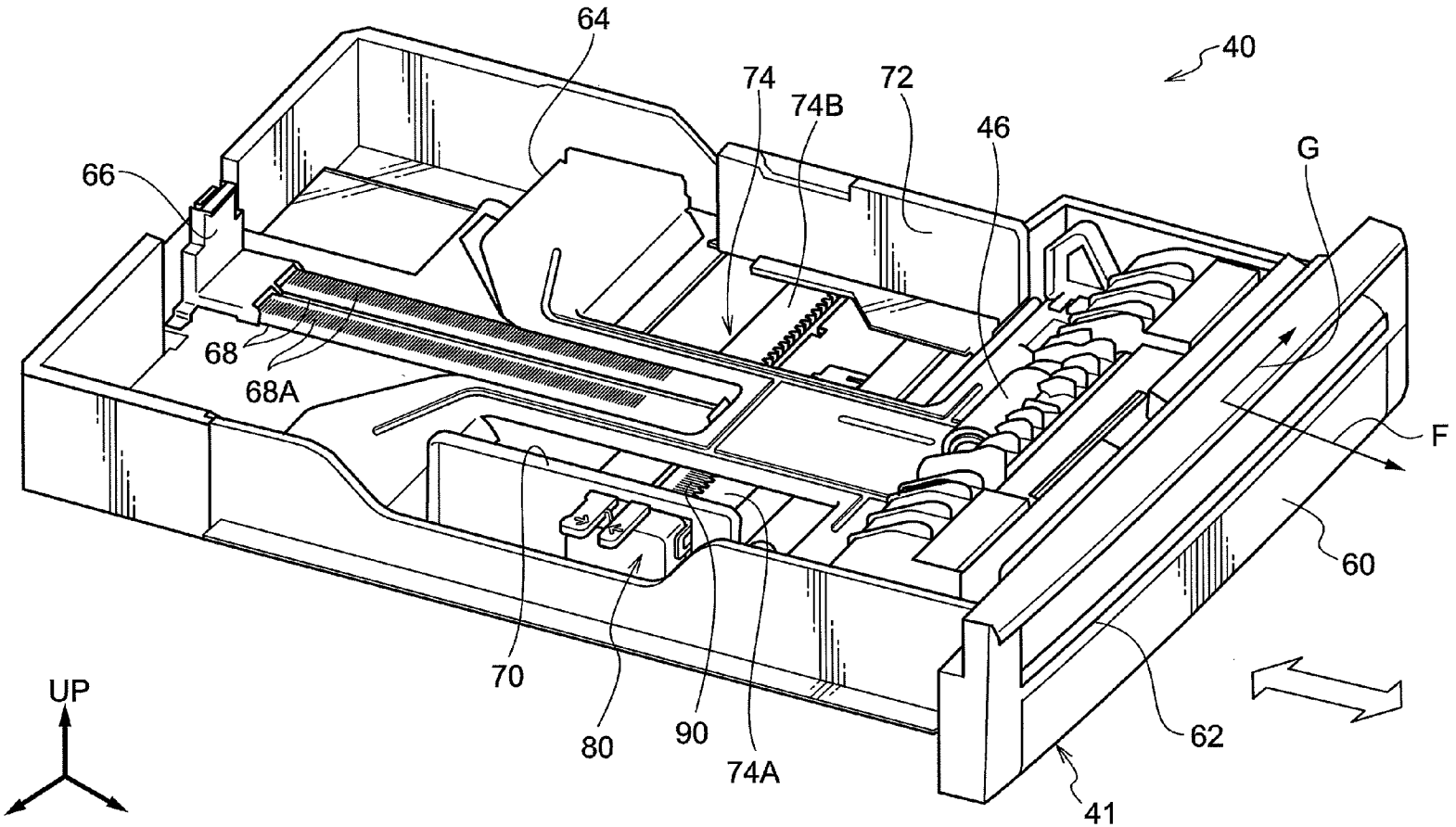
FIG. 2 is a perspective view showing a sheet member feeder device according to the first exemplary embodiment of the present invention.
Figure 3:
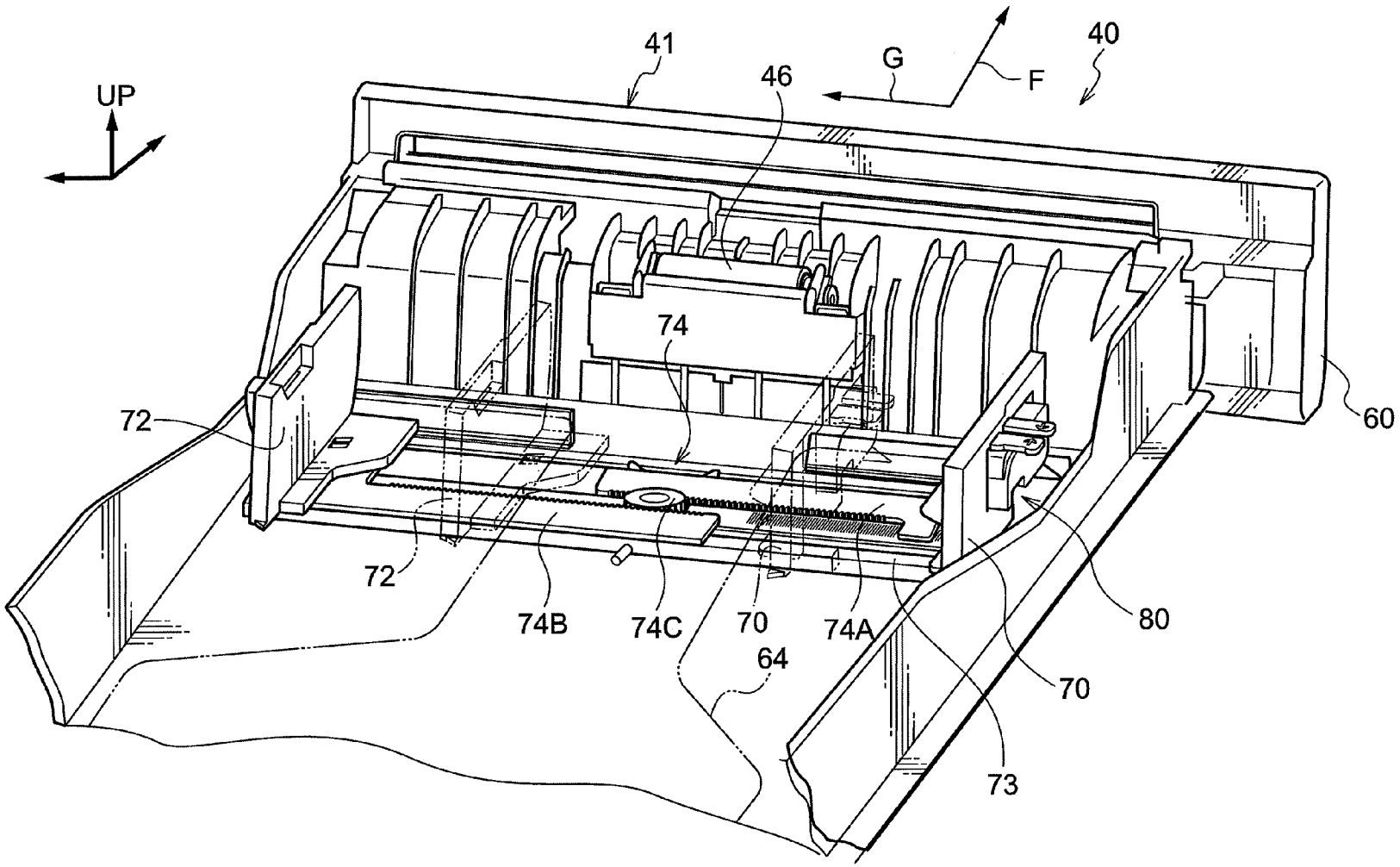
FIG. 3 is a perspective view showing an enlarged portion of a paper feed cassette employed in a sheet member feeder device according to the first exemplary embodiment of the present invention.

As shown in FIG. 2 and FIG. 3, the paper feed cassette 41 is a box shape that is open to the top, and a plate shaped bottom plate 64, on which the paper P is placed, is provided within the paper feed cassette 41.

The bottom plate 64 is movable up and down by a drive mechanism (not shown in the figures), and configuration is made such that the bottom plate 64 moves downwards when the paper feed cassette 41 is pulled out from the main body side-face cover 10B, allowing filling with paper P. However, the bottom plate 64 is raised by the drive mechanism when the paper feed cassette 41 is mounted to the image forming apparatus 10 through the opening 11 in the main body side-face cover 10B, and the uppermost paper P makes contact with the pick-up roll 42 (see FIG. 1). The bottom plate 64 is of substantially an H-shape in plan view, and a first side-guide 70 and a second side-guide 72, described below, are capable of moving the paper P in a direction (the arrow G direction) orthogonal to the paper P feed direction (the arrow F direction).

Furthermore, a plate shaped end guide 66 is provided within the paper feed cassette 41, at the opposite side to that of the separator roll 46, for positioning the paper P to be fed. The end guide 66 determines the position of the paper P in the paper feed direction (conveying direction) for feeding the paper P, and makes contact with the paper feed direction upstream end of the paper P, thereby determining the paper feed direction position of the paper P lying on the bottom plate 64.

The end guide 66 is supported by two rail members 68 that extend along the paper feed direction, such that the end guide 66 can be moved along the rail members 68 according to the size of the paper P. Plural protrusions and recesses 68A are formed on the top faces of the rail members 68 that extend along the paper feed direction, such that the end guide 66 is retained in the determined position in the paper feed direction by protrusion(s) (not shown in the figures) formed to the end guide 66 meshing with recess(es) of the protrusions and recesses 68A.

The plate shaped first side-guide 70, serving as an example of a guide member for positioning the paper P in the width direction that is perpendicular (orthogonal) to the paper feed direction, is provided in the paper feed cassette 41 such that the first side-guide 70 makes contacts with edges (side portions) of the paper P on a first width direction side.

The plate shaped second side-guide 72 for determining the width direction position of the paper P is provide in the paper feed cassette 41 at a position facing the first side-guide 70, with the paper P lying on the bottom plate 64 disposed between the second side-guide 72 and the first side-guide 70, and with the second side-guide 72 making contact with the opposite edges (side portions) of the paper P.

The first side-guide 70 and the second side-guide 72 are supported by a rail member 73, and are movable within the paper feed cassette 41 in the width direction.

Figure 4:
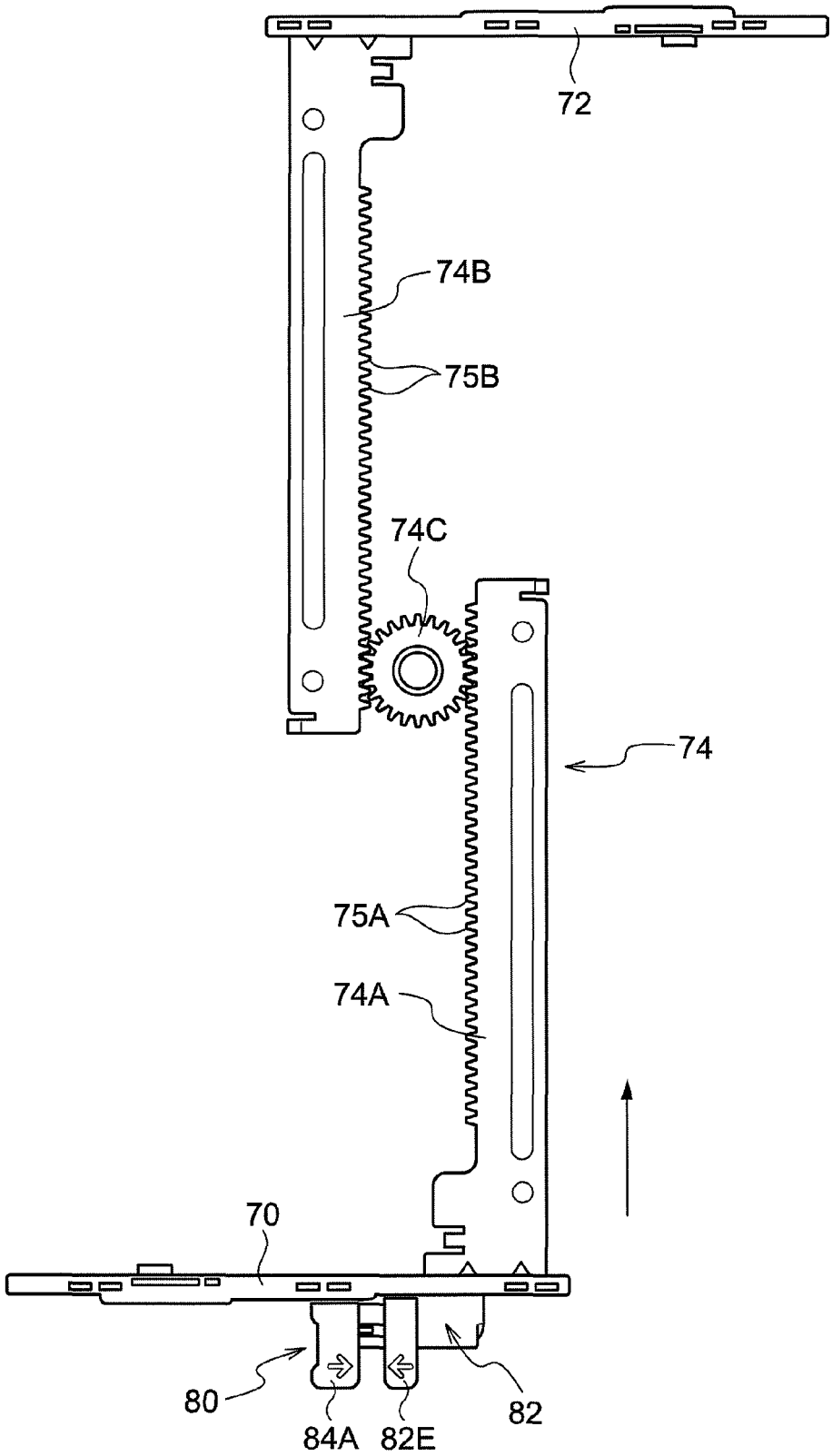
FIG. 4 is a plan view showing a first side-guide, a second side-guide, and a motive force transmission device employed in a sheet member feeder device.

As shown in FIG. 4, a motive force transmission device 74 is provided between the first side-guide 70 and the second side-guide 72, and transmits motive force to the second side-guide 72 when the first side-guide 70 is moved within the paper feed cassette 41 in the width direction, moving the second side-guide 72 according to the movement amount of the first side-guide 70.

The motive force transmission device 74 is equipped with a rack member 74A that is fixed to the first side-guide 70, extending out towards the second side-guide 72, and a rack member 74B that is fixed to the second side-guide 72, extending out towards the first side-guide 70. Plural teeth 75A are formed to the rack member 74A along the paper feed cassette 41 width direction, at positions on the rack member 74A that face the rack member 74B. Plural teeth 75B are formed to the rack member 74B along the paper feed cassette 41 width direction, at positions on the rack member 74B that face the rack member 74A. The motive force transmission device 74 is also equipped with a pinion 74C disposed between the rack member 74A and the rack member 74B, the pinion 74C meshing with the both the teeth 75A and 75B.

Due to such a configuration, for example, when the first side-guide 70 is moved towards the second side-guide 72, the rack member 74A fixed to the first side-guide 70 rotates the pinion 74C. When the pinion 74C rotates, this moves the rack member 74B fixed to the second side-guide 72, and the second side-guide 72 moves towards the first side-guide 70. The teeth 75A and 75B of the rack member 74A and the rack member 74B are formed in the same shape as each other, and so the movement amounts of the first side-guide 70 and the second side-guide 72 are also the same as each other.

Due to the first side-guide 70 and the second side-guide 72 being moved by the same amounts, determining the width direction position of the paper P, the paper feeder device 40 is of a structure that positions with reference to the width direction center of the paper P (center registration).

A lock device 80 is provided in the paper feed cassette 41 to lock the determined position of the first side-guide 70. As shown in FIG. 5 to FIG. 7C, the lock device 80 includes: a lock lever housing 82, fixed to a side face 70A on the width direction outside of the first side-guide 70; a manually operated lock lever 84, provided at the top of the lock lever housing 82; a latch lever 86, serving as an example of a restricting member, with operation force due to manual operation of the lock lever 84 being transmitted to the latch lever 86 and engaging the latch lever 86 with an engaged portion 90 on the bottom face of the paper feed cassette 41; and a wedge lever 88, provided between the latch lever 86 and the first side-guide 70, and serving as an example of a pressing member for moving the first side-guide 70 towards the paper P.

The engaged portion 90 is configured extending along the width direction on the bottom face of the paper feed cassette 41 with plural protrusion and recess shaped latches. Protrusion and recess shaped engaging portions 86A formed on the leading end of the latch lever 86 engage with the engaged portion 90 (see FIG. 6).

The lock lever housing 82 includes a side wall section 82A that is substantially parallel to the side face 70A of the first side-guide 70. As shown in FIG. 8 to FIG. 11, a shaft portion 82B is provided to the side wall section 82A, protruding out towards the first side-guide 70 at the paper feed direction upstream side (the arrow F direction) of the side wall section 82A. The shaft portion 82B rotatably supports the lock lever 84. An opening 92 (see FIG. 10) is provided diagonally above the lock lever housing 82, exposing a pinching portion 84A, described below, of the lock lever 84. The inside of the side wall section 82A is equipped with a shaft portion 82C, projecting out towards the first side-guide 70 from diagonally below in the paper feed downstream direction of the shaft portion 82B. The shaft portion 82C rotatably supports the latch lever 86 and the wedge lever 88. An opening 93 (see FIG. 10) is provided at the paper feed direction downstream side of the lock lever housing 82, exposing the engaging portions 86A of the latch lever 86. A pinching portion 82E that projects upwards is provided to a top face portion 82D of the lock lever housing 82.

The lock lever 84 is formed in substantially an L-shape in side view, including: a circular shaped hole portion 84B, provided at an intermediate portion of the lock lever 84 and fitting over the outside of the shaft portion 82B of the lock lever housing 82; the pinching portion 84A, provided at one end of the lock lever 84 and manually operated by a user; and a pin 84C, provided at the other end of the lock lever 84 and protruding out towards the first side-guide 70.

Figure 6:
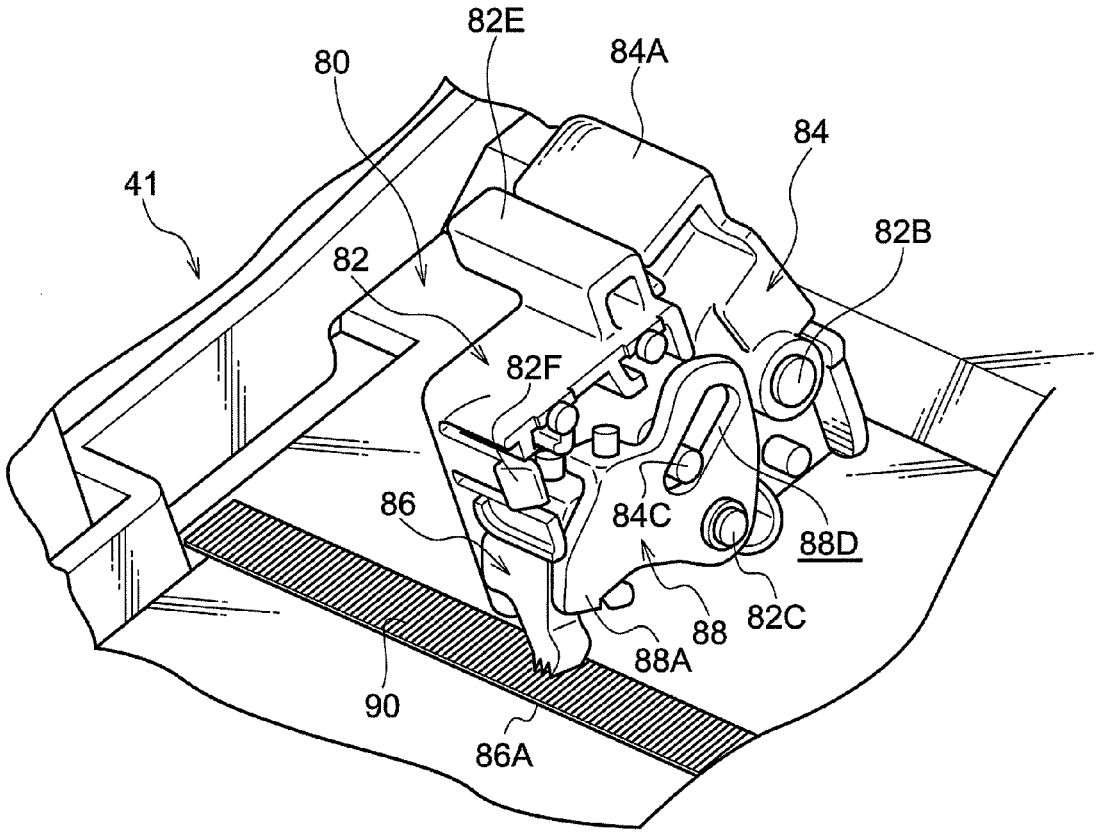
FIG. 6 is a perspective view showing a lock device employed in a sheet member feeder device.
Figure 7A:
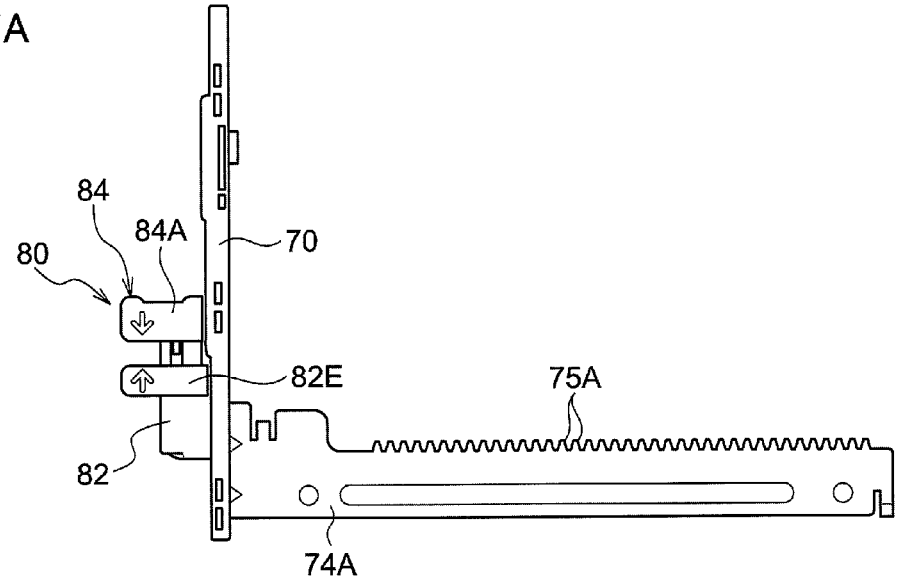
FIGS. 7A, 7B and 7C are diagrams showing a first side-guide and a lock device employed in a sheet member feeder device.
Figure 7B:
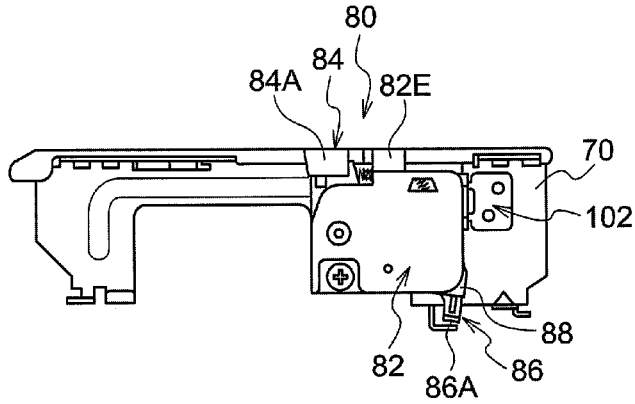
Figure 7C:
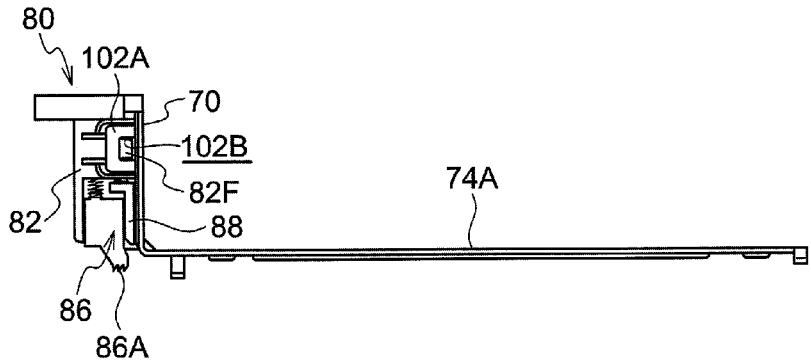

In a state in which the hole portion 84B is fitted over the outside of the shaft portion 82B, the lock lever 84 is rotatable about the shaft portion 82B in directions in which the pinching portion 84A approaches, or moves away from, the pinching portion 82E of the lock lever housing 82 (see FIG. 6). A coil spring 94 is provided between the pinching portion 84A of the lock lever 84 and the end portion of the lock lever housing 82 at the opening 92 side of the top face portion 82D (see FIG. 9). One end of the coil spring 94 fits over the outside of a protrusion 82G formed to the top face portion 82D, and the other end of the coil spring 94 is supported in the pinching portion 84A, by a recess 84D opening towards the top face portion 82D. A wall section 83 provided below the opening 92 of the lock lever housing 82 acts as a stopper, restricting rotation of the lock lever 84.

The latch lever 86 is formed in substantially an L-shape in side view, and includes the engaging portions 86A provided at one end of the latch lever 86, and a circular shaped hole portion 86B provided at the other end of the latch lever 86 and fitting over the outside of the base end of the shaft portion 82C of the lock lever housing 82.

A rectangular shaped recess 86C is provided as an example of a movement permitting section on the side face facing the first side-guide 70 of an intermediate portion of the latch lever 86. A protrusion 87 is provided below the recess 86C, to the side face of the latch lever 86 facing the wedge lever 88. The protrusion 87 is configured to make contact with the leading end 88A of the wedge lever 88, described below, when the leading end 88A of the wedge lever 88 is inserted further into a gap C (see FIG. 12) between the latch lever 86 and the first side guide 70. In other words, the minimum width of the gap C, into which the wedge lever 88 is further inserted, is restricted by the protrusion 87. A rectangular shaped protrusion 86D is also formed on the top face of the latch lever 86, projecting out upwards. In a state in which the hole portion 86B is fitted over the outside of the base end of the shaft portion 82C, the latch lever 86 is rotatable about the shaft portion 82C in both a direction (downwards) to engage the engaging portions 86A with the engaged portion 90 of the paper feed cassette 41, and in a direction (upwards) that moves the engaging portions 86A away from the engaged portion 90.

Figure 8:
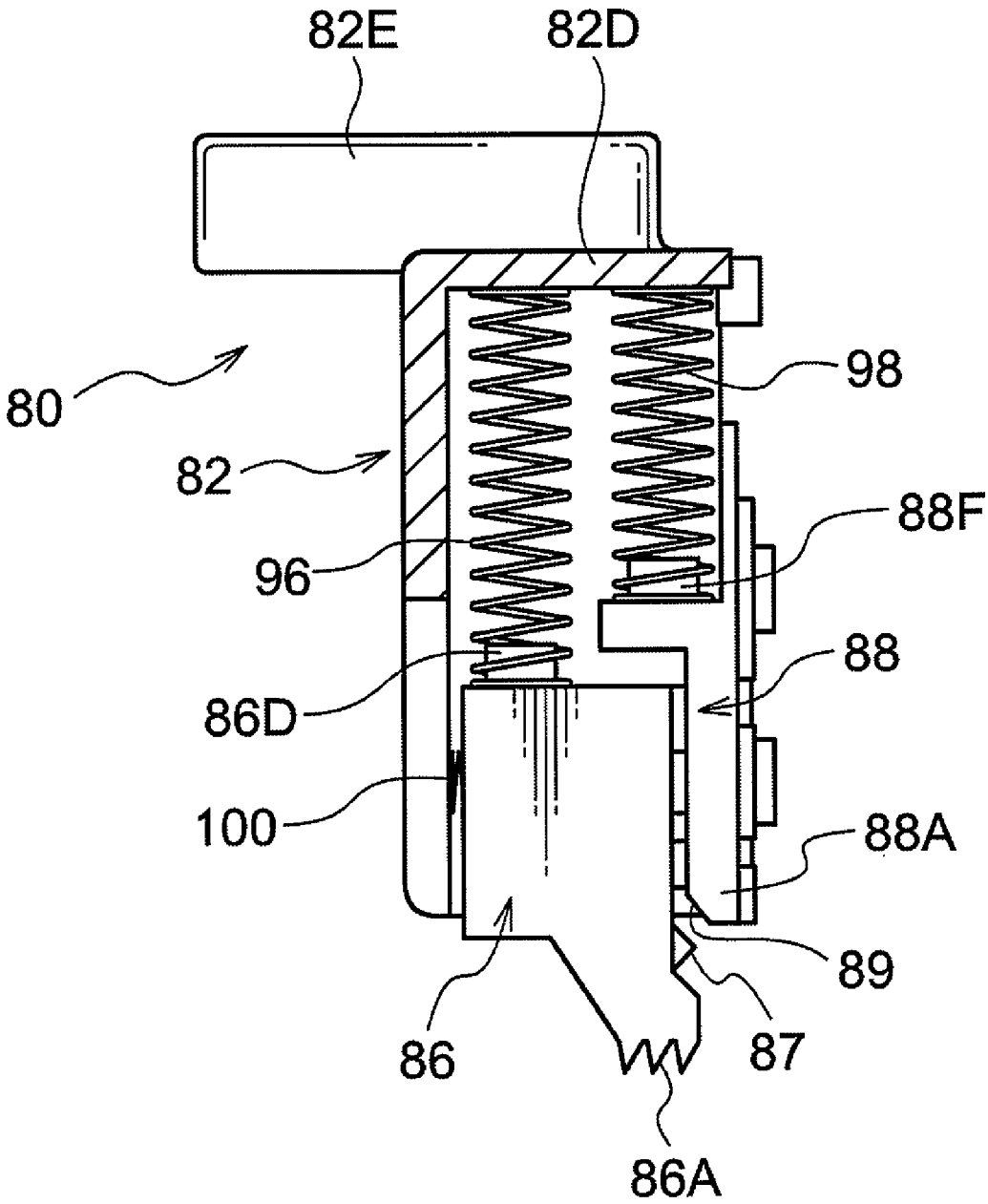
FIG. 8 is a cross-section showing a lock device.
Figure 11:
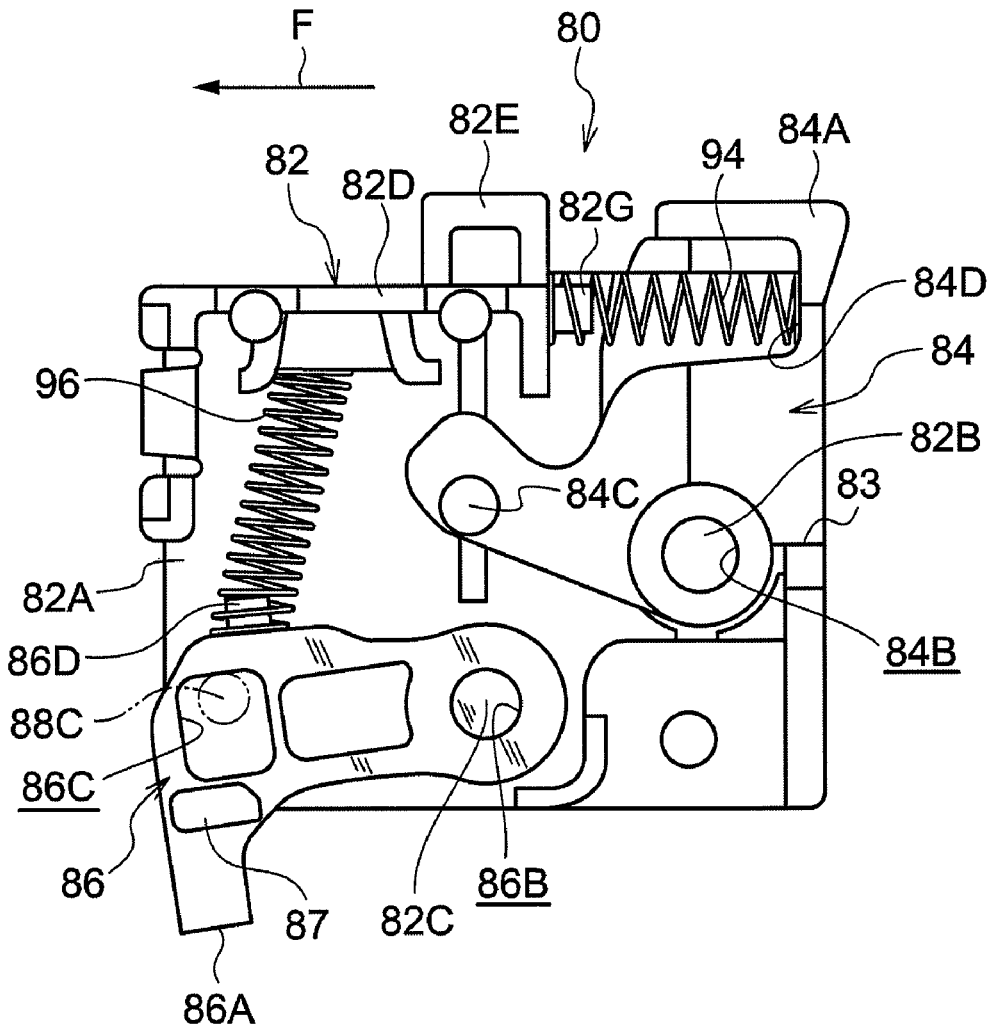
FIG. 11 is a configuration diagram showing the lock device of FIG. 9 in a state in which the wedge lever has been removed.

A coil spring 96 is provided between the top face portion 82D of the lock lever housing 82 and the latch lever 86, as an example of a first biasing member that biases the engaging portions 86A of the latch lever 86 in the direction of engagement with the engaged portion 90 of the paper feed cassette 41 (see FIG. 8 and FIG. 11). The bottom end of the coil spring 96 is fitted over the outside of a protrusion 86D on the latch lever 86, and the top end of the coil spring 96 is retained in a recess formed in the top face portion 82D.

The wedge lever 88 is formed from a plate shaped member and includes: the leading end 88A that faces the engaged portion 90 of the paper feed cassette 41, and a circular shaped hole 88B provided at a position separated from the leading end 88A and fitting over the outside of the leading end of the shaft portion 82C of the lock lever housing 82. In a state in which the hole portion 86B is fitted over the outside of the leading end of the shaft portion 82C, the wedge lever 88 is rotatable about the shaft portion 82C in directions in which the leading end 88A approaches, or move away from, the bottom face of the paper feed cassette 41. An angled face 89 is formed to the leading end 88A of the wedge lever 88, so as to slope away from the latch lever 86 on progressing towards the leading end (see FIG. 8).

A pin 88C, as an example of a contact portion, is provided to the wedge lever 88 at a position separated from the circular shaped hole 88B and projecting out towards the latch lever 86. The pin 88C is inserted into the recess 86C of the latch lever 86 in a state in which the circular shaped hole 88B is fitted over the outside of the shaft portion 82C. The recess 86C of the latch lever 86 is formed with a bigger external profile than that of the pin 88C, and the pin 88C is movable within the recess 86C in a rotation direction of the wedge lever 88. In a state in which the engaging portions 86A of the latch lever 86 are engaged with the engaged portion 90 of the paper feed cassette 41, and the leading end 88A is not inserted further into the gap C, the bottom side of the recess 86C acts as a movement permitting section that permits downwards movement (towards the bottom face of the paper feed cassette 41) of the pin 88C rotating together with the wedge lever 88.

An elongated hole 88D is formed in the wedge lever 88 with its length direction along a direction that intersects with a line joining the circular shaped hole 88B and the pin 88C. The pin 84C of the lock lever 84 is fitted into the elongated hole 88D in a state in which the circular shaped hole 88B is fitted over the outside of the shaft portion 82C.

Figure 9:
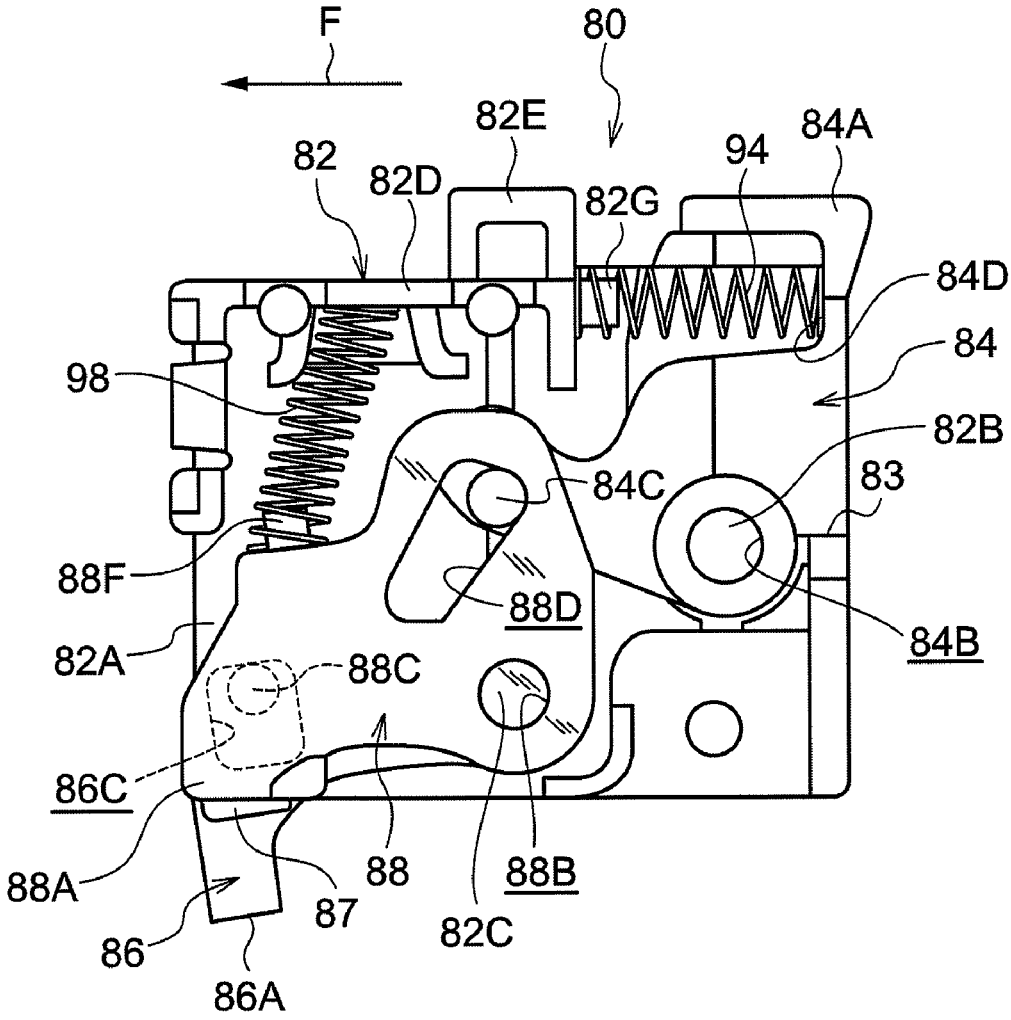
FIG. 9 is a configuration diagram showing an assembled state of a lock device.
Figure 10:
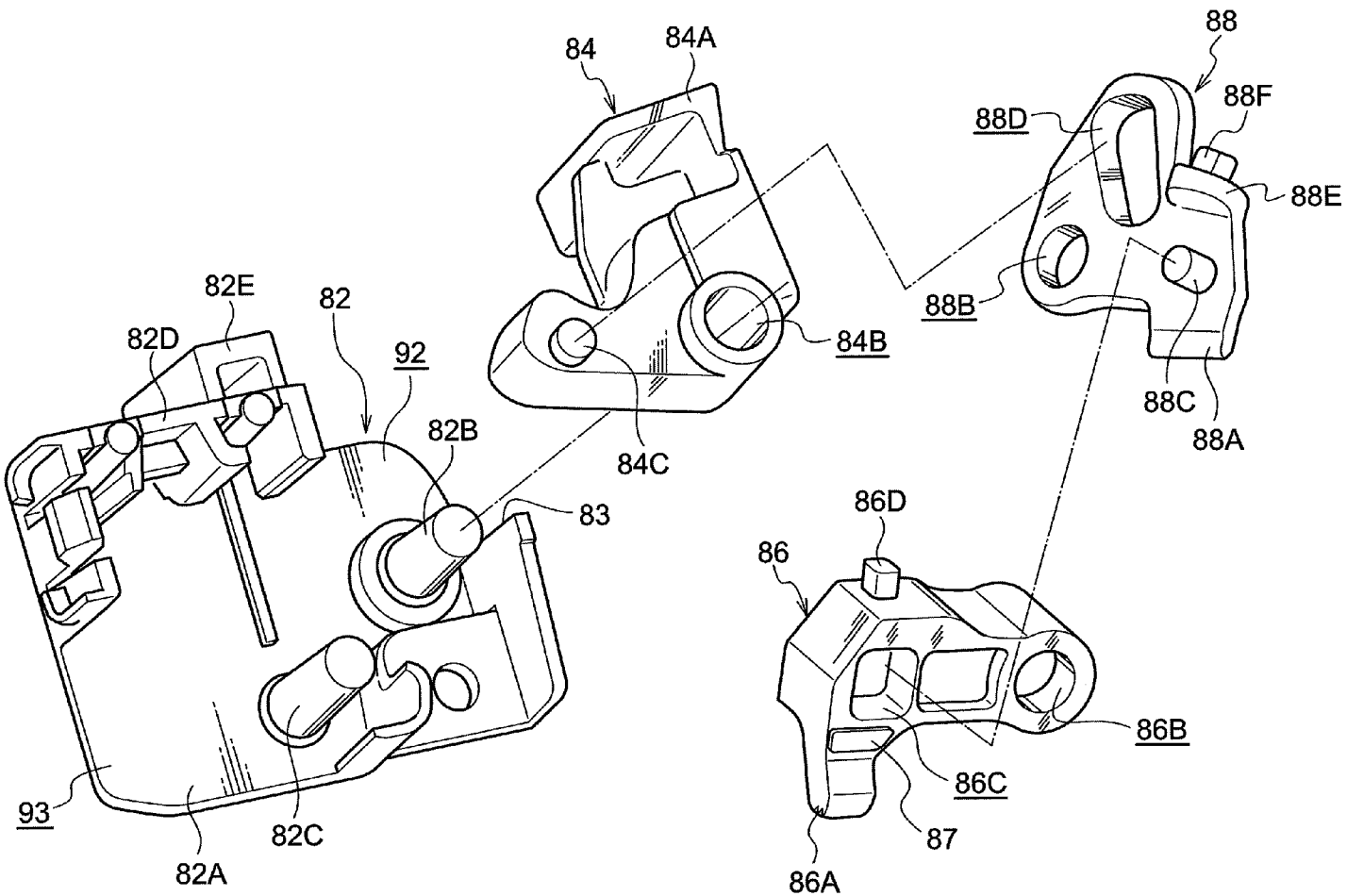
FIG. 10 is a perspective view showing a lock lever, a latch lever, a wedge lever, and a lock lever housing employed in a lock device.

A coil spring 98 is provided between the top face portion 82D of the lock lever housing 82 and the wedge lever 88, as an example of a second biasing member, biasing the leading end 88A of the wedge lever 88 in the direction (towards the bottom face of the paper feed cassette 41) of insertion further into a gap between the latch lever 86 and the first side-guide 70 (see FIG. 8 and FIG. 9). The bottom end of the coil spring 98 is fitted over the outside of a rectangular shaped protrusion 88F formed to the top face of a horizontal wall section 88E of the latch lever 86, and the top end of the coil spring 98 is retained in a recess formed to the top face portion 82D.

In a state in which the engaging portions 86A of the latch lever 86 are engaged with the engaged portion 90 of the paper feed cassette 41 and the leading end 88A is not inserted further into the gap C, the top end of the elongated hole 88D of the wedge lever 88 acts as a movement permitting section that permits the wedge lever 88 to be moved towards the bottom face of the paper feed cassette 41 without interfering with the pin 84C of the lock lever 84.

A coil spring 100 (see FIG. 8) is fitted over the outside of the shaft portion 82C of the lock lever housing 82, pressing the latch lever 86 towards the first side-guide 70. The protrusion 87 is provided projecting out towards the wedge lever 88 from a side face of the latch lever 86. When the leading end 88A of the wedge lever 88 rotates about the shaft portion 82C in the direction to approach the engaged portion 90 (movement so as to be inserted further between the latch lever 86 and the first side-guide 70), the angled face 89 of the wedge lever 88 is pressed by the protrusion 87 of the latch lever 86, such that the wedge lever 88 moves towards the first side-guide 70.

Figure 5:
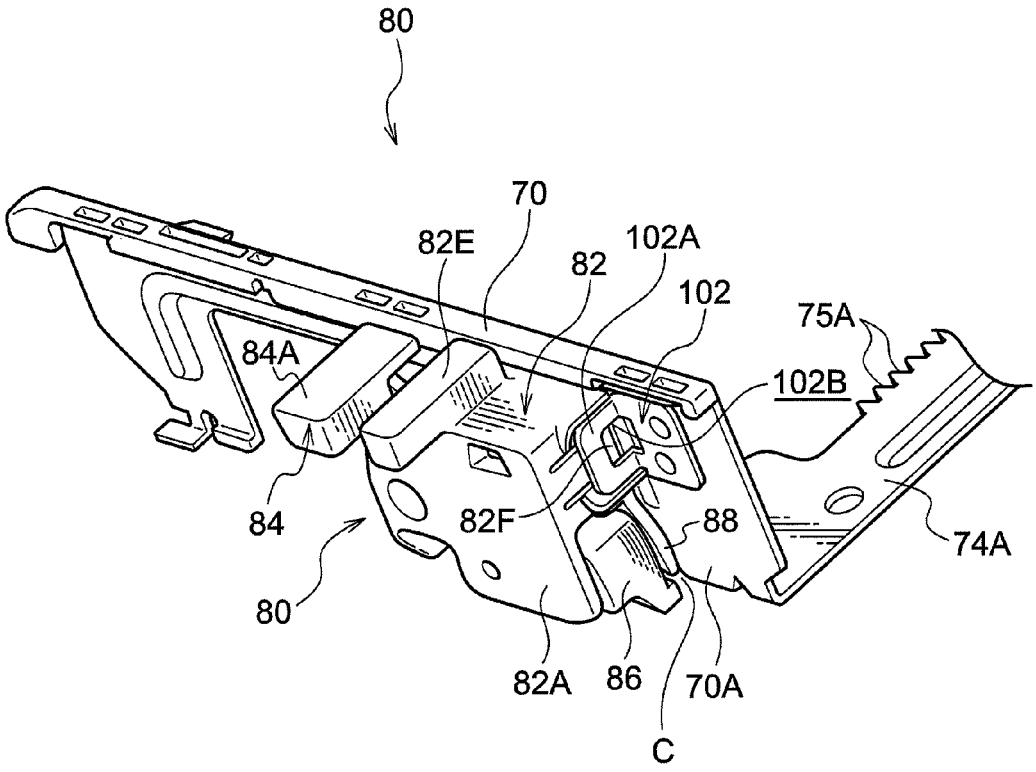
FIG. 5 is a perspective view showing a first side-guide and a lock device employed in a sheet member feeder device.

Furthermore, as shown in FIG. 5, a bracket 102, of substantially an L-shape in plan view, is attached to the side face 70A of the first side-guide 70, and an opening 102B is formed to a vertical wall section 102A of the bracket 102 that projects outwards in the width direction from the first side-guide 70. A latching claw 82F is provided to a portion of the wall of the lock lever housing 82 facing the bracket 102, for latching onto an edge of the opening 102B in the bracket 102. The lock lever housing 82 is fixed to the side face 70A of the first side-guide 70 by a fastener, not shown in the figures, in a state in which the latching claw 82F is latched onto the edge of the opening 102B in the bracket 102.

Figure 17:
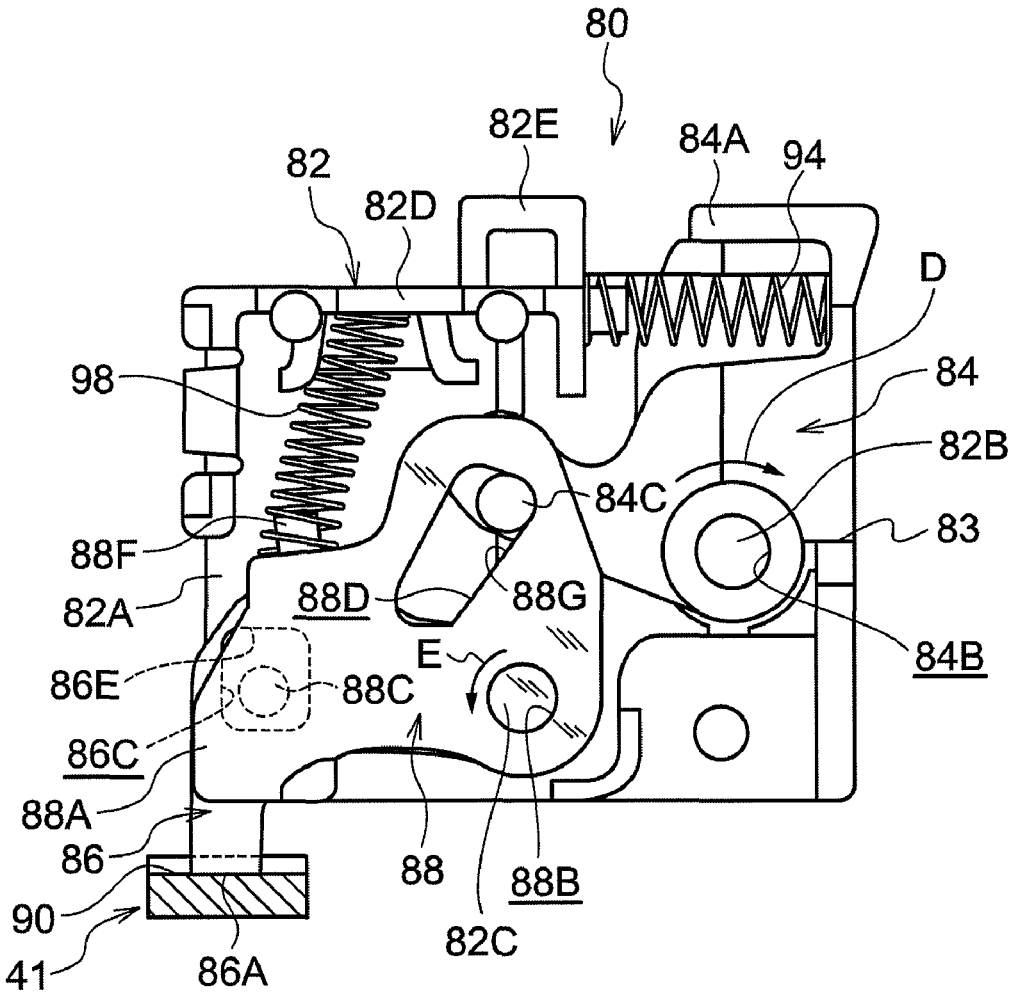
FIG. 17 is a diagram showing an operation process of configuration components of a lock device.

By such a configuration of the lock device 80, when in a state in which the pinching portion 84A of the lock lever 84 is not operated by a user, the engaging portions 86A of the latch lever 86 are engaged with the engaged portion 90 of the paper feed cassette 41 due to force from the coil spring 96, so as to be locked (see FIG. 17). In this state, the leading end 88A of the wedge lever 88 is pressed out into the gap C between the latch lever 86 and the first side-guide 70 due to force of the coil spring 98, such that the wedge lever 88 moves towards the bottom face of the paper feed cassette 41, relative to the latch lever 86. The first side-guide 70 thereby moves towards the paper P.

Figure 15:
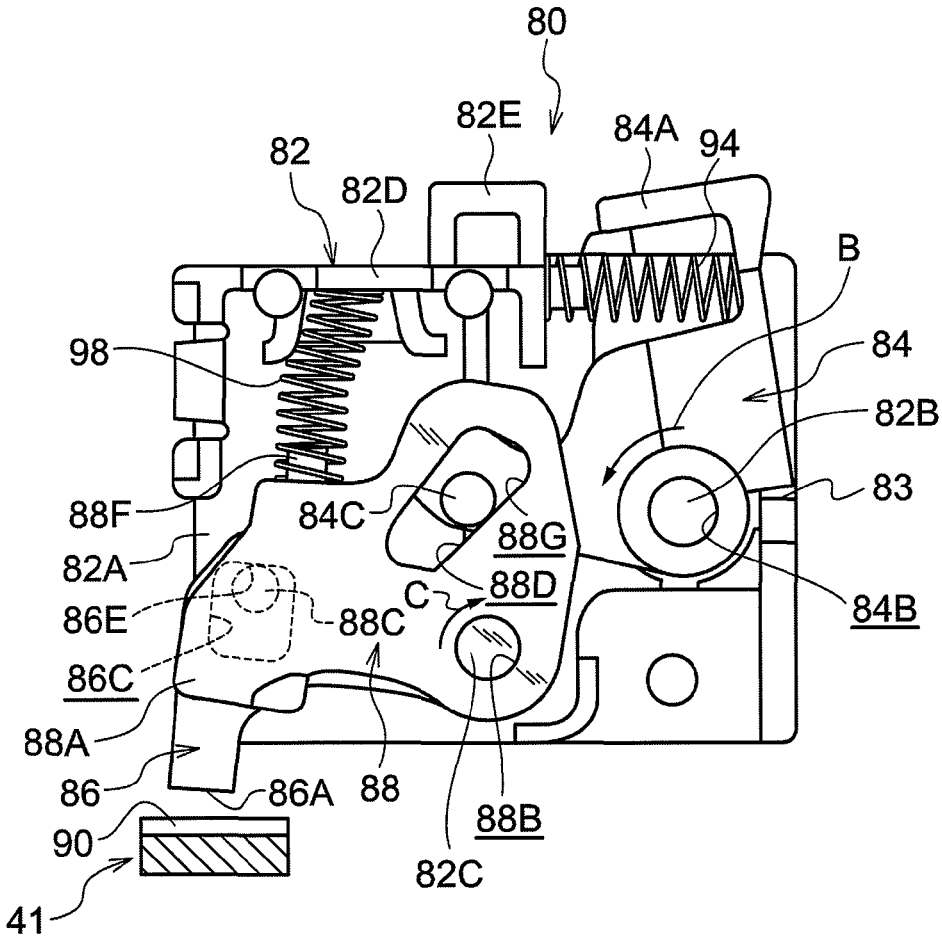
FIG. 15 is a diagram showing an operation process of configuration components of a lock device.

Furthermore, when the locked state of the latch lever 86 is being released (engagement of the engaging portions 86A of the latch lever 86 with the engaged portion 90 is being released), the pinching portion 82E of the lock lever housing 82 and the pinching portion 84A of the lock lever 84 are pinched together, such that operation force on the lock lever 84 is transmitted to the latch lever 86 through the wedge lever 88 by the pinching portion 84A of the lock lever 84 moving towards the pinching portion 82E against the force of the coil spring 94 (see FIG. 15). Namely, the pin 84C of the lock lever 84 presses against a bottom face 88G of the elongated hole 88D of the wedge lever 88 such that the wedge lever 88 rotates upwards (in the arrow C direction) against the force of the coil spring 98, about the shaft portion 82C. Furthermore, the pin 88C of the wedge lever 88 presses against a top face 86E of the recess 86C of the latch lever 86 such that the latch lever 86 rotates upwards (in the arrow C direction) against the force of the coil spring 96, about the shaft portion 82C.

Explanation of the operation of the paper feeder device 40 according to the present exemplary embodiment follows.

Figure 12:
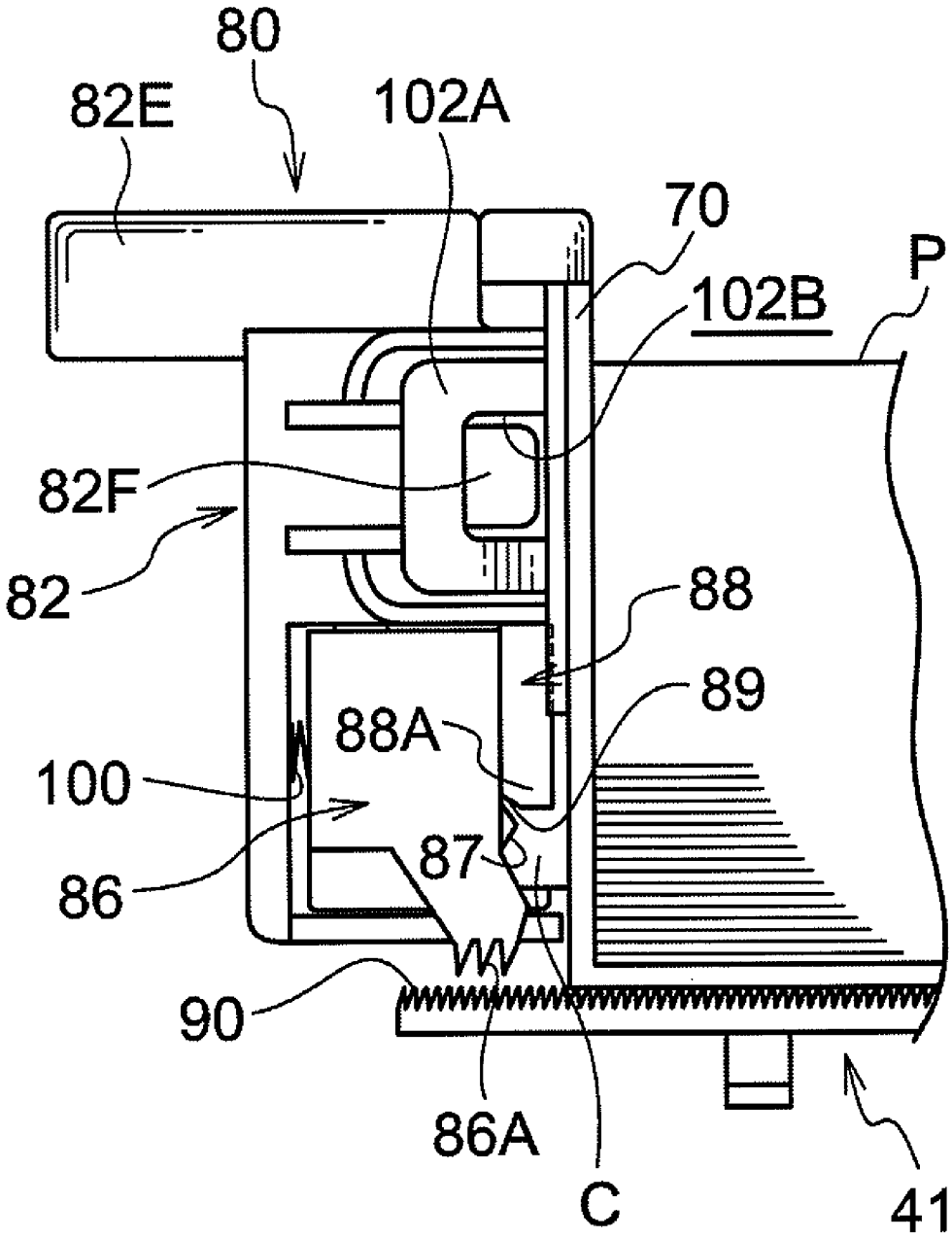
FIG. 12 is a front view showing an operation process of a first side-guide and lock device in a sheet member feeder device.

When the locked state of the latch lever 86 is being released, as shown in FIG. 15, the pinching portion 82E of the lock lever housing 82 and the pinching portion 84A of the lock lever 84 are pinched together, moving the pinching portion 84A of the lock lever 84 towards the pinching portion 82E against the fore of the coil spring 94. Due to this action, the lock lever 84 rotates downwards in FIG. 15 (the arrow B direction), about the shaft portion 82B, and due to the pin 84C of the lock lever 84 pressing the bottom face 88G of the elongated hole 88D of the wedge lever 88, the wedge lever 88 rotates upwards in FIG. 15 (the arrow C direction) against the force of the coil spring 98, about the shaft portion 82C. Accompanying this rotation, due to the pin 88C of the wedge lever 88 pressing the top face 86E of the recess 86C of the latch lever 86, the latch lever 86 rotates upwards in FIG. 15 against the force of the coil spring 96 (see FIG. 8), about the shaft portion 82C. Due thereto, as shown in FIG. 12, the engaging portions 86A of the latch lever 86 move in the direction of separation from the engaged portion 90 (upwards in FIG. 12), and the engagement between the engaging portions 86A and the engaged portion 90 of the paper feed cassette 41 is released.

Note that in the engaged state of the engaging portions 86A of the latch lever 86 with the engaged portion 90, since there is some play between the top face 86E of the recess 86C and the pin 88C of the wedge lever 88, the wedge lever 88 proceeds to rotate in the arrow C direction, and angled face 89 moves up above the protrusion 87.

In the lock released state of the latch lever 86, the first side-guide 70 is moved along the paper feed cassette 41 width direction up to the position where the edges (side portions) of the paper P are guided. When this action is taken, accompanying the movement of the first side-guide 70, the second side-guide 72 is moved by the motive force transmission device 74 in the opposite direction to the first side-guide 70, by the same movement amount as the first side-guide 70.

Figure 16:
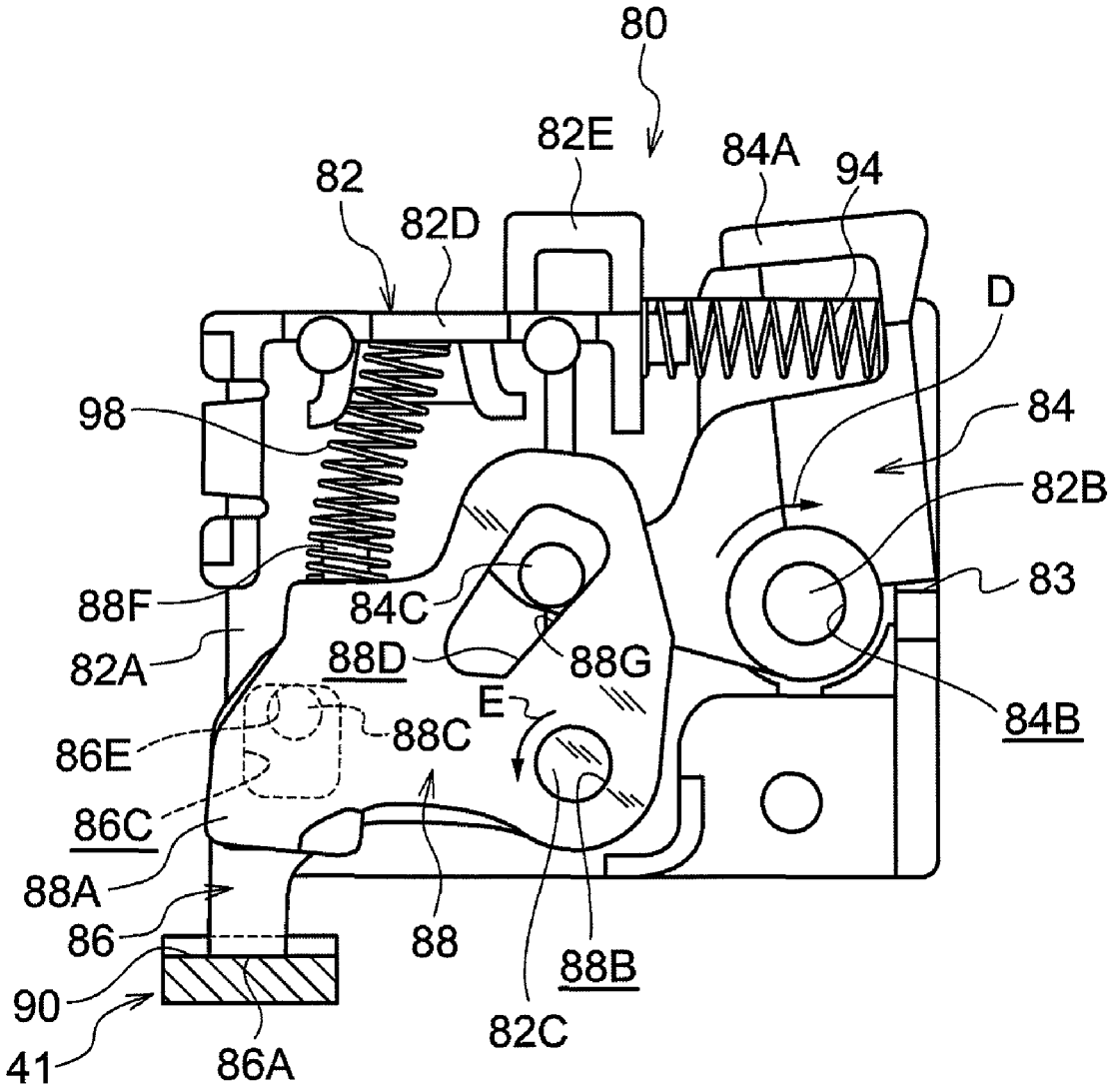
FIG. 16 is a diagram showing an operation process of configuration components of a lock device.

After the first side-guide 70 has been moved in the width direction, as shown in FIG. 16, if pressing action on the pinching portion 84A of the lock lever 84 is released, the pinching portion 84A moves in the direction to return to its original position (see FIG. 9) due to the force of the coil spring 94, and the pin 84C of the lock lever 84 slides along the elongated hole 88D of the wedge lever 88, and the lock lever 84 rotates to the right hand side in FIG. 16 (the arrow D direction).

When this occurs, the latch lever 86 rotates downwards in FIG. 16 (the arrow E direction) due to the force of the coil spring 96 (see FIG. 8), engaging the engaging portions 86A of the latch lever 86 with the engaged portion 90 of the paper feed cassette 41. Accompanying this movement, the elongated hole 88D of the wedge lever 88 slides against the pin 84C of the lock lever 84 due to force from the coil spring 98, rotating the wedge lever 88 downwards in FIG. 16 (the arrow E direction).

Figure 13:
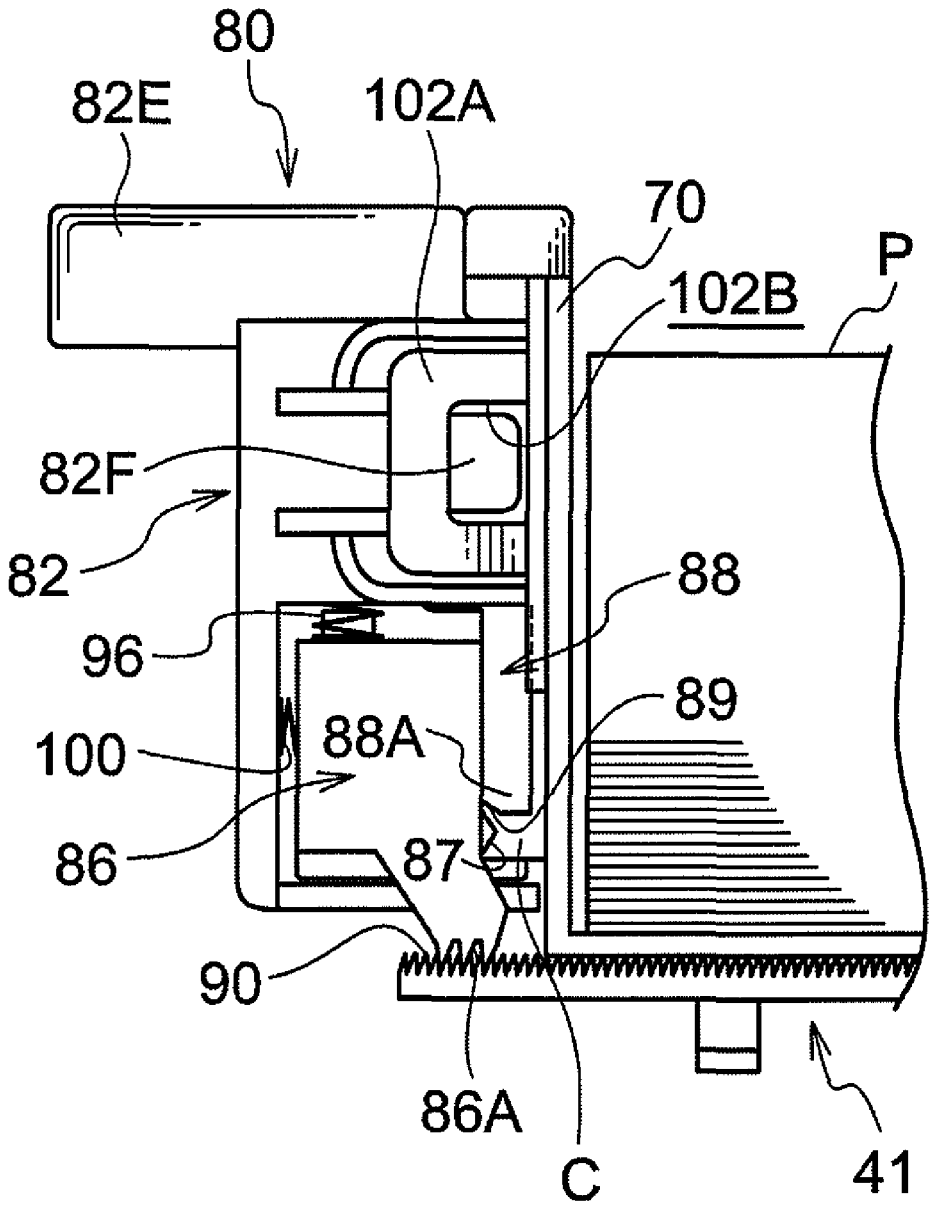
FIG. 13 is a front view showing an operation process of a first side-guide and lock device in a sheet member feeder device.

When the pressing action on the pinching portion 84A of the lock lever 84 is released, the first side-guide 70 attempts to align with the edges of the paper P such that no gap occurs therebetween. However, as shown in FIG. 13, when the engaging portions 86A of the latch lever 86 engage with the engaged portion 90 of the paper feed cassette 41, since the first side-guide 70 is positioned by the engaged portion 90 (having indentations of a pitch of, for example, about 0.5 mm), sometimes a difference occurs of a pitch's worth of the engaged portion 90, and a gap occurs between the first side-guide 70 and the sides of the paper P.

In the present exemplary embodiment, as shown in FIG. 16, when the engaging portions 86A of the latch lever 86 are engaged with the engaged portion 90, there is a gap (movement permitting section) between the top edge of the elongated hole 88D of the wedge lever 88 and the pin 84C of the lock lever 84, permitting the wedge lever 88 to move, and there is a gap between the bottom edge of the recess 86C of the latch lever 86 and the pin 88C of the wedge lever 88, permitting the wedge lever 88 to move. Therefore, as shown in FIG. 17, the wedge lever 88 rotates further downwards (the arrow E direction) after the engaging portions 86A of the latch lever 86 has engaged with the engaged portion 90.

Figure 14:
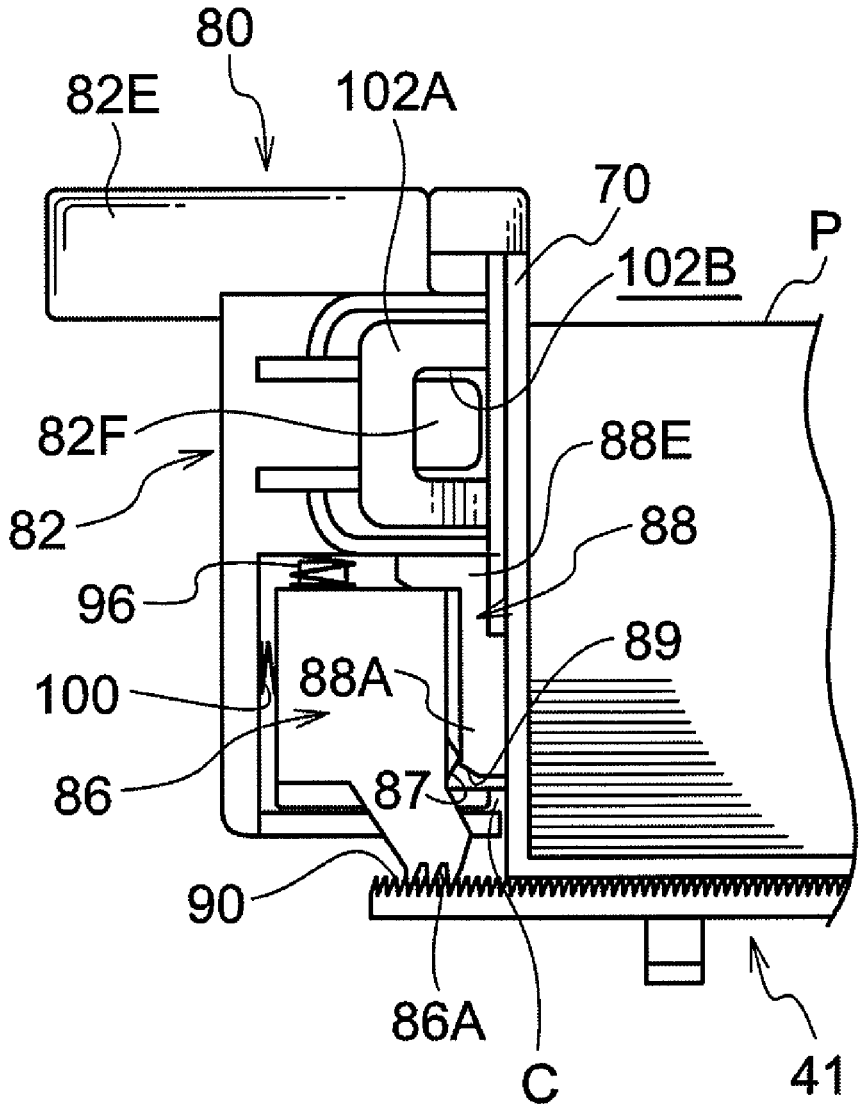
FIG. 14 is a front view showing an operation process of a first side-guide and lock device in a sheet member feeder device.

Due thereto, as shown in FIG. 14, the wedge lever 88 is inserted further into the gap C between the latch lever 86 and the first side-guide 70, and the wedge lever 88 is pressed by the protrusion 87 on the side portion of the latch lever 86 and moves relative to the latch lever 86 towards the paper P, forcibly widening the separation distance between the latch lever 86 and the first side-guide 70. Therefore, the first side-guide 70 is pressed by the wedge lever 88 and moves towards the paper P, and the gap between the first side-guide 70 and the paper P is reduced. Consequently, when the paper P is being conveyed, instances of paper being fed at an angle to the conveying direction are reduced in comparison to cases where the gap between the first side-guide 70 and the paper P has not been reduced.

Furthermore, there is a time difference from after the engaging portions 86A of the latch lever 86 has engaged with the engaged portion 90, up to when the wedge lever 88 is inserted further into the gap C between the latch lever 86 and the first side-guide 70, therefore when the wedge lever 88 presses the first side-guide 70, the first side-guide 70 can be moved towards the paper P, relative to the position of the latch lever 86.

Due to the angled face 89 of the wedge lever 88, the wedge lever 88 is more readily inserted further into the gap C between the latch lever 86 and the first side-guide 70 than in configurations where the angled face 89 is not provided. Furthermore, due to the angled face 89, the force pressing the first side-guide 70 increases according to the movement amount of the action further inserting the wedge lever 88 into the gap C. Consequently, by appropriate selection of the biasing force of the coil spring 98, when no gap is present between the first side-guide 70 and the edges (side portions) of the paper P, rotation of the wedge lever 88 can be stopped in a state of contact of the angled face 89 with the protrusion 87, such that the first side-guide 70 is not moved any further.

Furthermore, since the contact surface area of the latch lever 86 and the wedge lever 88 becomes smaller and frictional force is decreased due to the protrusion 87, further insertion of the wedge lever 88 into the gap C is facilitated in comparison to configurations where the protrusion 87 is not provided, and in addition the biasing force of the coil spring 98 can be made weaker.

Note that while detailed explanation has been given of a particular exemplary embodiment of the present invention, the present invention is not limited to the exemplary embodiment given, and a person of ordinary skill in the art will be aware that various other embodiments are possible within the scope of the present invention. For example, in the above exemplary embodiment, an example is explained of a configuration where the first side-guide 70, the second side-guide 72, and the like, of the present invention are employed in the paper feeder device 40 housed in the image forming apparatus 10, however, the present invention may be employed, for example, in a manual feed tray provided, for example, on a side face of an image forming apparatus.

In the above exemplary embodiment, the first side-guide 70 of the present invention is provided to the paper feeder device 40, and the second side-guide 72 is provided at a position facing the first side-guide 70. However, there is no limitation to configurations in which side-guides are provided on both sides of the paper feeder device 40, and a configuration may be employed in which the side-guide of the present invention is provided only to one side of the paper feeder device 40. The present invention may also be employed in the end guide 66.

In the above exemplary embodiment, as a configuration for moving the wedge lever 88 in the direction for insertion further into the gap between the latch lever 86 and the first side-guide 70, after the engaging portions 86A of the latch lever 86 have been engaged with the engaged portion 90, the movement permitting section, permitting movement of the wedge lever 88 without interfering with the pin 84C of the lock lever 84, is provided on the top edge of the elongated hole 88D of the wedge lever 88, and the movement permitting section, permitting movement of the wedge lever 88 is provided at the bottom edge of the recess 86C of the latch lever 86, however there is no limitation thereto, and change may be made to other configurations. For example, configuration may be made in which a pin is provided to the wedge lever 88 and an elongated hole is provided to the lock lever 84, and/or a recess is provided to the wedge lever 88 and a pin is provided to the latch lever 86.

In the above exemplary embodiment, the coil spring 94 and the coil spring 98 are provided in order to rotate the lock lever 84 and the wedge lever 88, however these may be rotated by manual operation, without employing coil springs.

In the above exemplary embodiment, the paper feeder device 40 is applied to the image forming apparatus 10, however there is no limitation thereto. For example, the paper feeder device 40 of the present invention may be applied to an image scanning device that reads in an image on a sheet member (original), or to an original feeder device that feeds a sheet member (original).

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A sheet member feeder device comprising:

a sheet member housing section that houses a sheet member for feeding;

a guide member, provided so as to be movable in approach-separation directions that approach towards, or separate away from, an edge of the sheet member housed in the sheet member housing section, the guide member guiding the edge of the sheet member;

a restricting member that is provided to the guide member, the restricting member engaging with an engaged portion provided to the sheet member housing section and restricting movement of the guide member in the approach-separation directions; and a pressing member that, if the restricting member is engaged with the engaged portion, then presses the guide member towards the sheet member by the pressing member inserting further into a gap between the restricting member and the guide member, wherein at least a leading end portion of the pressing member is formed at an angle relative to the direction of insertion operation further into the gap, and wherein a protrusion is formed to a side face of the restricting member, and the pressing member is configured such that the leading end portion formed at an angle thereto makes contact with the protrusion when being inserted further into the gap.

2. A sheet member feeder device comprising:

a sheet member housing section that houses a sheet member for feeding;

a guide member, provided so as to be movable in approach-separation directions that approach towards, or separate away from, an edge of the sheet member housed in the sheet member housing section, the guide member guiding the edge of the sheet member;

a restricting member that is provided to the guide member, the restricting member engaging with an engaged portion provided to the sheet member housing section and restricting movement of the guide member in the approach-separation directions;

a pressing member that, if the restricting member is engaged with the engaged portion, then presses the guide member towards the sheet member by the pressing member inserting further into a gap between the restricting member and the guide member;

a pressing out structure that presses the pressing member out so as to be inserted further into the gap between the restricting member and the guide member after the restricting member has engaged with the engaged portion;

a first biasing member that biases the restricting member in a direction to engage with the engaged portion; and a contact portion that is provided to the pressing member and makes the restricting member move integrally with the pressing member in a direction to release engagement of the restricting member with the engaged portion by making contact with the restricting member, if engagement of the restricting member with the engaged portion is to be released;

wherein the pressing out structure comprises:

a second biasing member that biases the pressing member in a direction of insertion further into the gap between the restricting member and the guide member; and a movement permitting section that is provided to the restricting member, the movement permitting section permitting movement of the contact portion in a biasing direction of the second biasing member after the restricting member has engaged with the engaged portion.

* * * * *